US008810346B2

(12) United States Patent
Goubely et al.

(10) Patent No.: US 8,810,346 B2
(45) Date of Patent: Aug. 19, 2014

(54) ELECTROMAGNETIC ACTUATOR COMPRISING A MAGNETIC TUBE AND USED FOR ACTUATING A HYDRAULIC OR PNEUMATIC VALVE

(75) Inventors: Aimé Goubely, LaTrinite (FR); Pascal Gantelme, Le Cannet (FR); Luca Cassini, San Remo (IT); Gillian Escandell, Nice (FR); Eric Passolunghi, Contes (FR)

(73) Assignee: BorgWarner Inc., Auburn Hills, MI (US)

( * ) Notice: Subject to any disclaimer, the term of this patent is extended or adjusted under 35 U.S.C. 154(b) by 1286 days.

(21) Appl. No.: 11/989,899

(22) PCT Filed: Aug. 2, 2006

(86) PCT No.: PCT/FR2006/001876

§ 371 (c)(1),
(2), (4) Date: Apr. 15, 2010

(87) PCT Pub. No.: WO2007/015008

PCT Pub. Date: Feb. 8, 2007

(65) Prior Publication Data

US 2010/0194504 A1 Aug. 5, 2010

(30) Foreign Application Priority Data

Aug. 3, 2005 (FR) ..... 05 08288

(51) Int. Cl.
*H01F 7/08* (2006.01)
*H01F 7/16* (2006.01)

(52) U.S. Cl.
CPC ..... *H01F 7/1607* (2013.01); *H01F 2007/085* (2013.01); *H01F 2007/163* (2013.01); *H01F 7/081* (2013.01)
USPC ..... 335/260; 335/282

(58) Field of Classification Search
USPC ..... 335/260
See application file for complete search history.

(56) References Cited

U.S. PATENT DOCUMENTS

| | | | | | |
|---|---|---|---|---|---|
| 2,324,642 | A | * | 7/1943 | Peterson | 335/260 |
| 3,805,203 | A | * | 4/1974 | Deckard | 335/239 |
| 4,044,324 | A | * | 8/1977 | Coors | 335/260 |
| 4,236,131 | A | * | 11/1980 | Grandclement | 335/260 |
| 4,462,013 | A | * | 7/1984 | Ueda et al. | 335/229 |
| 4,609,897 | A | * | 9/1986 | DeKoster et al. | 335/133 |
| 4,643,393 | A | * | 2/1987 | Kosugi et al. | 251/129.01 |
| 4,683,454 | A | * | 7/1987 | Vollmer et al. | 335/299 |
| 4,694,270 | A | * | 9/1987 | Ichihashi | 335/260 |
| 4,983,941 | A | * | 1/1991 | Tanaka | 335/255 |
| 5,263,647 | A | * | 11/1993 | Cerny et al. | 239/585.1 |
| 5,460,350 | A | * | 10/1995 | Nagashima et al. | 251/129.15 |

(Continued)

*Primary Examiner* — Shawki S Ismail
*Assistant Examiner* — Lisa Homza
(74) *Attorney, Agent, or Firm* — Warn Partners, P.C.

(57) ABSTRACT

The electromagnetic actuator comprises an electric coil mounted in a magnetic yoke, first and second pole parts, which are connected to the yoke and each of which extends near a free space in which a magnetic core is translationally displaceable by the action of the power supply to the electric coil and the formation of different magnetic fields in the pole parts. The inventive actuator consists of a tubular part, which is made of a magnetic material, delimits, at least partially, the free space, surrounds the magnetic core for guiding the displacement thereof and has magnetically continues with the pole parts in such a way that the radial air gap between the magnetic core and the magnetic pole parts is reduced.

7 Claims, 3 Drawing Sheets

(56) References Cited

U.S. PATENT DOCUMENTS

| | | | | | |
|---|---|---|---|---|---|
| 5,527,117 | A * | 6/1996 | Roy | 400/109.1 |
| 5,845,672 | A * | 12/1998 | Reuter et al. | 137/315.03 |
| 5,950,605 | A * | 9/1999 | Hussey et al. | 123/568.26 |
| 6,029,704 | A * | 2/2000 | Kuroda et al. | 137/625.65 |
| 6,229,415 | B1 * | 5/2001 | Quentric | 335/131 |
| 6,390,443 | B1 | 5/2002 | Katayama et al. | |
| 7,611,121 | B2 * | 11/2009 | Iwa et al. | 251/129.15 |
| 8,446,240 | B2 * | 5/2013 | Swartzentruber et al. | 335/151 |
| 2004/0178378 | A1 | 9/2004 | Collins et al. | |
| 2008/0251747 | A1 * | 10/2008 | Cobianchi et al. | 251/129.15 |

* cited by examiner

ELECTROMAGNETIC ACTUATOR COMPRISING A MAGNETIC TUBE AND USED FOR ACTUATING A HYDRAULIC OR PNEUMATIC VALVE

CROSS-REFERENCE TO RELATED APPLICATIONS

This application is a National Stage of International Application No. PCT/FR2006/001876, filed Aug. 2, 2006, which claims the priority of French Patent Application Serial No. FR 0508288, filed Aug. 3, 2005.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

Field of the Invention

The present invention pertains to the general technical field of electromagnets, and more particularly to the technical field of electromagnetic actuators. The latter are for example used to actuate hydraulic or pneumatic valves.

Electromagnetic actuators are known comprising an electric coil mounted in a magnetic yoke exhibiting a first pole part and a second pole part which are secured to the yoke and which each extend in the vicinity of a side of a free space in which there moves a magnetic core, mobile in translation under the effect of the electrical power supply of the electric coil and of the appearance of a different magnetic polarity at the pole parts.

Electromagnets used in electromagnetic actuators, which comprise a discontinuous magnetic circuit are known for example. The electric coils housed in this magnetic circuit generate a magnetic flux in a core when a current flows through them. The magnetic cores then serve to channel the magnetic flux which forms a north/south magnetic loop. Under the effect of the magnetic flux, the mobile core is then driven towards the position which will promote optimal circulation of this magnetic flux. Recourse is therefore had to electromagnetic actuators in which the magnetic core is positioned in an asymmetric manner, implying that said core is not in a position where the magnetic fluxes exhibit a symmetric configuration. The stable position in which the configuration of the magnetic flux is symmetric corresponds to the position which the magnetic core will adopt under the effect of the magnetic field. The appearance of the magnetic field will therefore give rise to a displacement of the magnetic core and the provision of an actuation force.

In this principle of construction, there are always interruptions in the magnetic circuit, either to promote the displacement of the magnetic core by way of radial play, or so as to magnetically short-circuit the north and south magnetic poles of the coil.

The discontinuity of the magnetic circuit between the poles induces defects of alignment of the mobile core producing, due to radial electromagnetic forces, detrimental rubbing that may even result in a phenomenon called "magnetic stiction" of the mobile core.

In order to alleviate this kind of problem, it is appropriate to resort to constructions that are complex, bulky and expensive due to the necessity to use more constituent pieces of an electromagnetic actuator.

Furthermore, for electric valves comprising cores immersed in a fluid circuit, for example liquid, and requiring leaktightness to the outside, recourse is had to devices interposed between the free space in which the magnetic core and the coil move. These devices constitute gas that is detrimental to the good circulation of the magnetic fluxes. These gaps made of amagnetic materials, promote the aforesaid drawbacks.

During the fabrication of electromagnetic actuators, it is therefore often necessary to design devices to ensure the leaktightness of the electrical part, to guarantee the guidance and the mobility of the core and to avoid magnetic short-circuits. These devices constitute gaps, in particular radial, at the level of the mobile core or magnetic pole parts, doing so through the use of a magnetic material. In a known manner, a magnetic short-circuit would contribute to an appreciable decrease in the performance of the electromagnetic actuator.

The aim of the present invention is to optimize the performance of an electromagnetic actuator while reducing the costs related to the construction of said actuator, as well as to the fabrication of its constituent pieces. It is therefore sought to simplify the electromagnetic actuator without being detrimental to its performance.

Another aim of the present invention is to ensure leaktighness between the electrical part and the hydraulic part of an electromagnetic actuator with simple and inexpensive means.

BRIEF SUMMARY OF THE INVENTION

According to the invention, the electromagnetic actuator comprises a tubular part made of magnetic material, delimiting at least in part the free space and surrounding the magnetic core, so as to guide the displacement of said magnetic core, said tubular part exhibiting a magnetic continuity with the pole part or parts, so as to reduce the radial gap between the magnetic core and the magnetic pole part or parts.

Contrary to the received wisdom, it is possible to optimize, or indeed to improve, the performance of an electromagnetic actuator magnetically short-circuiting the two pole parts so as to guide the displacement of the mobile core while reducing the radial gap between said core and the pole part or parts to the minimum functional play, necessary for the relative displacement of said pieces. The magnetic junction between the two pole parts is therefore not a drawback, according to the present invention.

According to an exemplary embodiment, the tubular part exhibits on the side of a pole part an extremity constituting a stop for the magnetic core.

According to an exemplary embodiment, the tubular part is shaped and/or positioned to achieve leaktightness between the free space and the electric part, comprising in particular the electric coil. It is therefore possible to eliminate any specific leaktightness part or device. Furthermore, simplified construction of the actuator in accordance with the invention is achieved.

According to an exemplary embodiment, the tubular part constituting a magnetic continuity between the two pole parts exhibits at least locally a wall of small thickness, chosen to minimize the leakages of magnetic flux between the pole parts.

The use of a magnetic short-circuit makes it possible to optimize the performance of the electromagnetic actuator in accordance with the invention. The effects of a reduced radial gap, due to the use of a tubular and magnetic part, in magnetic continuity with the pole parts, greatly offsets the drawbacks related to the appearance of a magnetic short-circuit across the tubular part.

The magnetic short-circuit is controlled by the choice of the dimensions of the cross-section of the tubular part. The absence of specific guidance and leaktightness pieces also makes it possible to increase the section of the mobile core, thus improving the performance of the actuator in accordance with the invention. It has not been possible to obtain noteworthy performance such as this with known electromagnetic actuators. It is therefore possible to envisage, within the framework of the present invention, decreasing the bulkiness, in particular of the electric coil, while preserving the performance of a known electromagnetic actuator.

The use of a magnetic material for the tubular part is also a more economical technical solution than the use of an amagnetic material, since it is henceforth possible for the two pole parts and the tubular part which separated them to be made from a single piece.

Furthermore, it is possible to eliminate the guidance rings on the core which were necessary to guide the core precisely because there is no longer any defect of alignment.

According to an exemplary embodiment, the tubular part exhibits a wall of constant and small thickness, for example less than a few tenths of a millimeter.

According to another exemplary embodiment, the tubular part exhibits a reduced cross-section over a portion of its length. By way of example, the tubular part is at least partially a constituent of the second pole part, of which a linking end comprising the reduced cross-section is secured to the first pole part.

According to an exemplary embodiment, the tubular part is at least in part a constituent of both pole parts, which are separated by the portion exhibiting the reduced cross-section. The tubular part is added on for example to the magnetic yoke.

The tubular part can also be added on to the first pole part and to the yoke.

According to another exemplary embodiment, the tubular part is added on to both pole parts, for example by welding, keying or adhesive bonding.

The electromagnetic actuator in accordance with the invention also exhibits the advantage of a mechanical construction in which the intermediate-linking mechanical pieces and elements are best eliminated, reducing by the same token the defect of displacement or of alignment between the pieces. This particularly beneficial when it is appropriate to align for example two shaft bearings. This alignment will be all the better when the bearings are machined simultaneously from one and the same constituent piece for example of both pole parts rather than from separate pieces assembled together.

The present invention also pertains or also relates to a hydraulic or pneumatic valve comprising an electromagnetic actuator as presented above.

BRIEF DESCRIPTION OF THE SEVERAL VIEWS OF THE DRAWINGS

Other characteristics and advantages will also emerge from the detailed description hereinafter, with reference to the appended drawings, given by way of nonlimiting examples, in which.

DETAILED DESCRIPTION OF THE INVENTION

Figure 1:
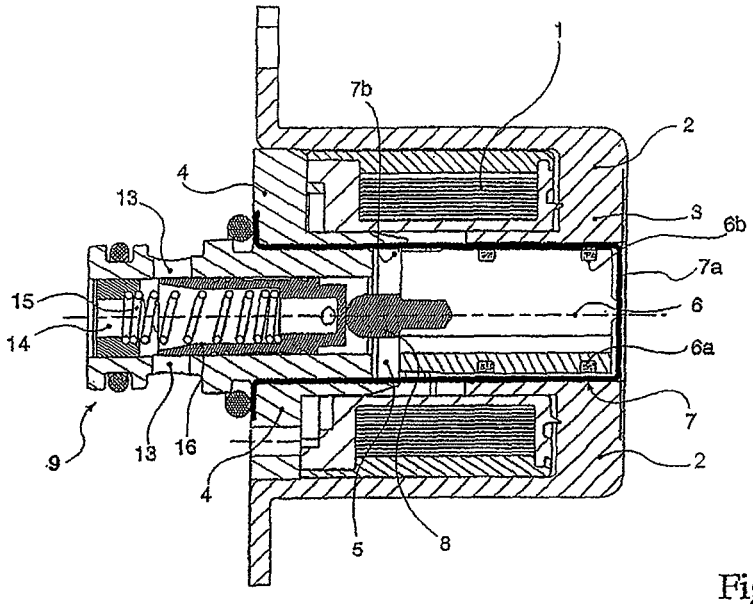
FIG. 1 is a sectional representation of an exemplary embodiment of an electromagnetic actuator in accordance with the invention, associated with a valve.

The electromagnetic actuator in accordance with the invention, and represented in FIGS. 1 to 4, comprises an electric coil (1) mounted in an outer magnetic yoke (2). The electromagnetic actuator exhibits a first pole part (3) and a second pole part (4) secured to the yoke (2). The pole parts (3) and (4) advantageously each extend circumferentially adjacent a side of an axial free space (5) in which there moves a magnetic core (6). The latter is mobile in translation under the effect of the electrical power supply of the coil (1) and of the appearance of a different magnetic polarity of the pole parts (3) and (4).

The electromagnetic actuator in accordance with the invention also comprises a tubular part (7) made of magnetic material. The tubular part (7) circumferentially delimits the free space (5) at least in part and surrounds the magnetic core (6), which exhibits for example a circular cross-section. The tubular part (7) makes it possible to guide the displacement of the magnetic core (6). Furthermore, the tubular part (7) exhibits a magnetic continuity with the pole part or parts (3) and (4) making it possible to reduce to the minimum the radial gap between the magnetic core (6) and the magnetic pole part or parts (3) and (4) due to the elimination of any defect of alignment between them. Therefore, in the actuator in accordance with the invention, there is no amagnetic intermediate part effecting a guidance interface between the magnetic pole parts (3) and (4) and the magnetic core (6). The tubular part (7), advantageously consisting of the same magnetic material as the pole parts (3) and (4), thus makes it possible to now form just a single part thus dispensing with the need to create linking and leaktightness means that are indispensable when the elements consist of different materials.

Figure 3:
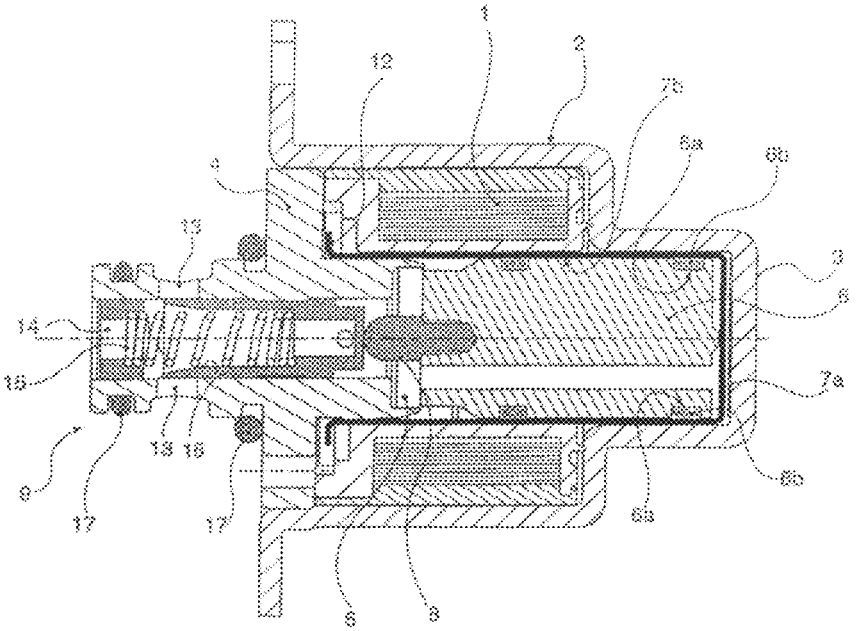
FIG. 3 is a sectional representation of another exemplary embodiment of an electromagnetic actuator in accordance with the invention, associated with a valve.

According to an exemplary embodiment of FIG. 1 or 3, the magnetic core (6) exhibits peripheral grooves (6*a*) in which are housed guidance annuli or blocks (6*b*) promoting the displacement and the alignment of said magnetic core (6) in the tubular part (7).

The electromagnetic actuator of FIGS. 1 and 3 also comprises a pusher (8) passing through the axial gap located in the free space (5) between an axial end of the magnetic core (6), and an axial end opposite the second pole part (4) or a part added on in magnetic continuity with the second pole part (4). The gap thus corresponds to a portion of the free space (5) that may be perceived in the figures. Advantageously, the tubular part (7) exhibits an extremity or extreme end (7*a*) constituting a stop for the magnetic core (6).

In the exemplary embodiments of FIGS. 1 and 3, it is the body of a valve (9), for example hydraulic, which constitutes a part of the second pole part (4) partially delimiting the free space (5).

The tubular part (7) is shaped and/or positioned to achieve leaktighness between the free space (5) and the electric part of the electromagnetic actuator, comprising in particular the electric coil (1). The tubular part (7), in accordance with the invention, constitutes a magnetic continuity between the two pole parts (3) and (4) and exhibits at least locally a wall of small thickness chosen to minimize (sometimes referred to as providing a flux choke) magnetic flux leakages. It is thus possible to minimize the effect termed magnetic "short-circuit" between the two pole parts (3) and (4).

According to the exemplary embodiment of FIGS. 1 and 3, the tubular part (7) exhibits a wall of constant and small thickness, for example less than a few tenths of a millimeter. By way of example, the thickness of the tubular part (7) lies between 35/100 and 55/100 of a millimeter.

Figure 2:
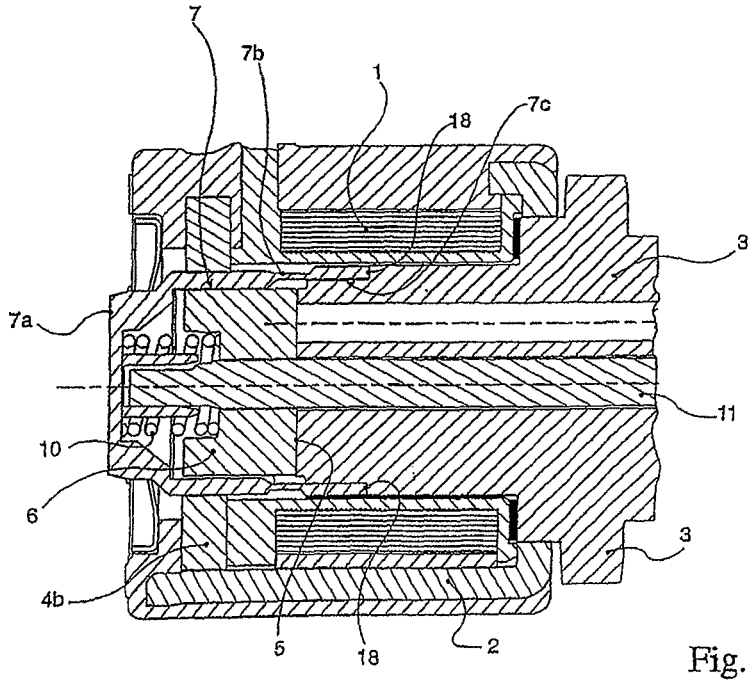
FIG. 2 is a sectional representation of another exemplary embodiment of an electromagnetic actuator in accordance with the invention.
Figure 4:
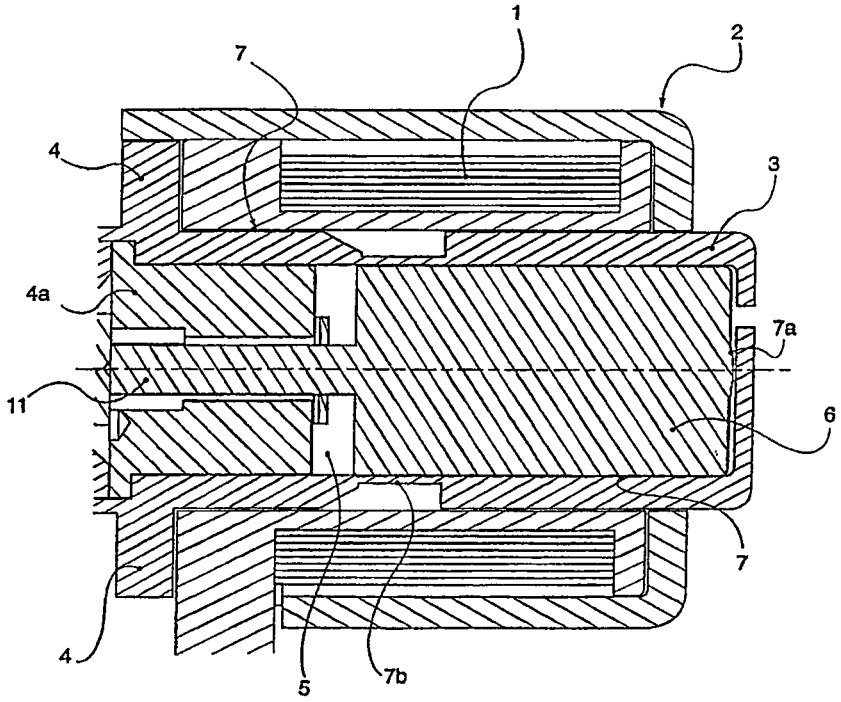
FIG. 4 is a sectional view of another exemplary embodiment of an electromagnetic actuator in accordance with the invention.

According to another exemplary embodiment, represented for example in FIG. 2 or 4, the tubular part (7) exhibits a reduced cross-section (7*b*) over a portion of its length. Reduced cross-section should be understood to mean a smaller thickness, taken according to a cross-section. In the example of FIG. 2, the tubular part (7) is a constituent of the second pole part (4) of which a linking end (7*c*) comprises the reduced cross-section (7*b*). This linking end is furthermore secured to the first pole part (3).

The magnetic core (6) is mounted in the tubular part (7) together with a spring (10) helping to hold this core in position. The displacement of the magnetic core (6) also drives the displacement of a rod (11) secured to said magnetic core (6). It is this rod (11) which actuates for example the hydraulic or pneumatic valve (9).

According to an exemplary embodiment, represented for example in FIG. 4, the tubular part (7) is a constituent of both pole parts (3) and (4), which are separated by a portion exhibiting the reduced cross-section (7*b*). The two pole parts (3) and (4) are thus made as a single constituent piece of the tubular part (7). The extremity (7*a*) of the latter part also makes it possible to constitute a stop for the mobile core (6). The rod (11) actuating for example a hydraulic or pneumatic valve also passes through a complementary pole part (4*a*) in magnetic continuity with the second pole part (4). The complementary pole part (4*a*) advantageously makes it possible to axially delimit the free space (5) and consequently the axial gap relevant thereto.

The tubular part (7) passes through or penetrates the magnetic yoke (2) and can be added on, and if appropriate fixed, to the magnetic yoke (2) for example with the aid of welds, keying, crimping or any other means of assembly.

According to the exemplary embodiment of FIG. 2, the tubular part (7) is added on and fixed to the pole part (3) by a weld lead (18).

In the exemplary embodiment of FIG. 4, the tubular part (7) is added on to the magnetic yoke (2) directly.

In the exemplary embodiments of FIGS. 1 and 3, the tubular part (7) is added on and fixed by any known means and in particular by weld bead and/or by keying in the two pole parts (3) and (4). Fixing ends (12) may also be provided.

The present invention also related to hydraulic or pneumatic valves (9), as represented for example in FIGS. 1 and 3, and actuated by an electromagnetic actuator in accordance with the invention. These valves (9) exhibit a body in magnetic continuity with the second pole part (4), as is represented in FIG. 1, or a direct constituent body of said second pole part (4), as is represented in FIG. 3. The valve (9) exhibits inlet (13) and outlet (14) orifices as well as an elastic restoring means (15) acting on a shutter member (16) actuated by the magnetic core (6). The hydraulic or pneumatic valves (9) known as such are not described in greater detail here. They are advantageously associated with seals (17) allowing a leaktight joint on a pipe (not represented).

The tubular part (7) of an electromagnetic actuator in accordance with the invention also exhibits the advantage of improving the precision of guidance and displacement of the magnetic core (6) with respect to the pole parts (3) and (4).

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. An electromagnetic actuator for a solenoid valve comprising an electric coil mounted in an outer magnetic yoke, a first pole part and a second pole part which are secured to the yoke and which each extend circumferentially adjacent a side of an axial free space in which therein moves a magnetic core, mobile in translation under an effect of the electrical power supply of the electric coil and an appearance of a different magnetic polarity at the pole parts and, wherein the electromagnetic actuator includes a tubular part made of magnetic material, circumferentially delimiting at least partially the free space and surrounding the magnetic core, so as to guide a displacement of said magnetic core, said tubular part exhibiting a magnetic continuity with the pole parts and concentrically aligning said pole parts so as to reduce a radial gap between the magnetic core and the magnetic pole parts, said tubular part being a single piece member entirely surrounding said magnetic core and radially contacting said first and second pole parts, said tubular part having an extreme end constituting a stop for said magnetic core and an opposite extreme end with a cross-sectional L shaped flange.

2. The electromagnetic actuator as claimed in claim 1, wherein the tubular part has an extreme end constituting a stop for the magnetic core.

3. The electromagnetic actuator as claimed in claim 1, wherein the tubular part achieves leaktightness between the axial free space and the electrical part comprising in particular the electric coil.

4. The electromagnetic actuator as claimed in claim 3, wherein the tubular part has at least one section of a wall of small thickness, chosen to minimize leakages of magnetic flux between the pole parts.

5. The electromagnetic actuator as claimed in claim 4, wherein the tubular part exhibits a wall of constant small thickness between 0.35 and 0.55 millimeters.

6. The electromagnetic actuator as claimed in claim 1, wherein the tubular part contacts the second pole part along an inner radial surface of the tubular part.

7. The electromagnetic actuator as claimed in claim 1, wherein the tubular part contacts the second pole part along an outer radial surface of the tubular part.

* * * * *